US010844507B2

(12) United States Patent
Bunn et al.

(10) Patent No.: US 10,844,507 B2
(45) Date of Patent: Nov. 24, 2020

(54) CATHODE SYSTEM FOR ELECTRODEPOSITION OF METALS ON MICROSPHERES

(71) Applicant: Lawrence Livermore National Security, LLC, Livermore, CA (US)

(72) Inventors: Thomas L. Bunn, Livermore, CA (US); Corie Horwood, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 279 days.

(21) Appl. No.: 15/965,317

(22) Filed: Apr. 27, 2018

(65) Prior Publication Data

US 2018/0371635 A1 Dec. 27, 2018

Related U.S. Application Data

(60) Provisional application No. 62/522,746, filed on Jun. 21, 2017.

(51) Int. Cl.

| | |
|---|---|
| ***C25D 17/08*** | (2006.01) |
| ***C25D 7/00*** | (2006.01) |
| ***C25D 17/12*** | (2006.01) |
| ***C25D 21/10*** | (2006.01) |
| ***C25D 5/20*** | (2006.01) |

(52) U.S. Cl.

CPC ..... *C25D 17/12* (2013.01); *C25D 5/20* (2013.01); *C25D 7/00* (2013.01); *C25D 17/08* (2013.01); *C25D 21/10* (2013.01)

(58) Field of Classification Search

USPC ..... 204/297.11; 118/500

See application file for complete search history.

(56) References Cited

U.S. PATENT DOCUMENTS 4,062,751 A * 12/1977 Yamada ..... C25D 17/00 204/212
4,316,786 A 2/1982 Yu et al.
5,744,013 A * 4/1998 Botts ..... C25D 17/12 204/242

(Continued)

FOREIGN PATENT DOCUMENTS

WO 2006106221 A2 10/2006

OTHER PUBLICATIONS

Meyer, S.F., 1981. Metallic coating of microspheres. Journal of Vacuum Science and Technology, 18(3), pp. 1198-1204.

(Continued)

*Primary Examiner* — Harry D Wilkins, III

(74) *Attorney, Agent, or Firm* — Harness, Dickey & Pierce, P.L.C.

(57) ABSTRACT

The present disclosure relates to an apparatus for electroplating an element. The apparatus may comprise a cathode cage assembly. The cathode cage assembly may include a cage member and at least one electrically conductive wire extending along at least a portion of the cage member. The wire may be arranged to form at least one volume within the cage member for retaining an element within the cage member. The cage member and the wire permit a degree of movement of the element during an electroplating process while retaining the element within the volume.

19 Claims, 5 Drawing Sheets

(56) References Cited

U.S. PATENT DOCUMENTS

| | | | | |
|---|---|---|---|---|
| 5,766,430 | A * | 6/1998 | Mehler | C25D 17/12 204/259 |
| 7,828,945 | B2 * | 11/2010 | Yamamoto | C25D 17/24 204/297.01 |
| 8,246,797 | B2 | 8/2012 | Botrel et al. | |
| 8,573,148 | B2 * | 11/2013 | Pacetti | B05B 13/0442 118/500 |
| 2011/0059227 | A1 * | 3/2011 | Pacetti | B05B 13/0442 427/2.25 |

OTHER PUBLICATIONS

Jankowski, A.F., Saw, C.K., Harper, J.F., Valher, B.F., Ferreira, J.L. and Hayes, J.P., 2006. Nanocrystalline growth and grain-size effects in Au—Cu electrodeposits. Thin Solid Films, 494 (1-2), pp. 268-273.

Brun, E., Durut, F., Botrel, R., Theobald, M., Legaie, O., Popa, I. and Vignal, V., 2011 Influence of the Electrochemical Parameters on the Properties of Electroplated Au—Cu Alloys. Journal of the Electrochemical Society, 158(4), pp. D223-D227.

Jankowski, A.F., Saw, C.K. and Hayes, J.P., 2006. The thermal stability of nanocrystalline Au—Cu alloys. Thin Solid Films, 515(3), pp. 1152-1156.

Durut, F., Botrel, R., Brun, E., Tacon, S.L., Chicanne, C., Vincent-Viry, O., Theobald, M. and Vignal, V., 2016. Phenomenological Model for Gold-Copper Electrodeposition: Application to Thick Coatings. Fusion Science and Technology, 70(2), pp. 341-350.

Durut, F., Botrel, R., Brun, E., Tacon, S.L., Chicanne, C., Vincent-Viry, O., Theobald, M. and Vignal, V., 21st Target Fabrication Meeting Jun. 21-25, 2015. Specific Plating Process on Plastic Capsules: Application to Thick Gold-Copper Coatings. https://meetings.lle.rochester.edu/TFab_2015/media/presentations/Tuesday/MachiningRoboticsCoatings/Tuesday_310_Durut.pdf, 70(2), pp. 341-350.

* cited by examiner

CATHODE SYSTEM FOR ELECTRODEPOSITION OF METALS ON MICROSPHERES

CROSS-REFERENCE TO RELATED APPLICATIONS

This application claims the benefit of U.S. Provisional Application No. 62/522,746, filed on Jun. 21, 2017. The entire disclosure of the above application is incorporated herein by reference.

STATEMENT OF GOVERNMENT RIGHTS

The United States Government has rights in this invention pursuant to Contract No. DE-AC52-07NA27344 between the U.S. Department of Energy and Lawrence Livermore National Security, LLC, for the operation of Lawrence Livermore National Laboratory.

FIELD

The present disclosure relates to systems and methods for electroplating objects, and more particularly to a system and method for electroplating small spherical balls in a manner that produces a highly uniform metallic coating.

BACKGROUND

This section provides background information related to the present disclosure which is not necessarily prior art.

When attempting to use metal shell capsules as hydrogen isotope fuel containers for laser induced, inertial confinement experiments, as well as other applications, a number of important coating quality characteristics must be considered. One overall goal in manufacturing metal shell capsules is to be able to produce fully dense, metal electrodeposits onto microsphere mandrels. The electrodeposited coatings should ideally have outstanding surface smoothness and thickness uniformity. The coating surface finish should ideally be as good as the mandrel, and the coating composition and thickness must be controllable within close manufacturing tolerances. Ideally, the process should work equally well for low and high density microspheres, that is, objects that float or sink.

Previous attempts at manufacturing small, spherical, metallic shells for the above-described application have involved barrel plating. Barrel plating is a well-established, metal electrodeposition method for making temporary contact with components. Researchers have also attempted methods to roll spheres on straight wall surfaces during the plating process. Other attempts have involved attaching an electrical lead to the microsphere, as well as rolling spheres in confined tracks (e.g., WO 2006106221 A3).

Barrel plating is not suitable for use with sub-millimeter sized components. Other challenges with barrel plating are the high risk of surface damage and the lack of any effective way to track the uniformity of the coatings formed on individual microspheres. Still further, barrel plating is not practical (or feasible) for small batches where thickness uniformity and surface smoothness are important quality characteristics that need to be achieved.

Straight wall conducting surfaces (cathodes) that are also electroplated similarly suffer from significant drawbacks such as uneven build ups of coatings on the conducting surfaces. Microspheres can stick, and metal ions in the electrolyte used during this process are consumed rapidly, which is especially undesirable when precious metals must be used as the coating material.

Applying a coating to the microspheres by using electrical lead attachments are also undesirable because this method results in asymmetrical coatings and leaves unacceptable scars on the microsphere surface.

SUMMARY

This section provides a general summary of the disclosure, and is not a comprehensive disclosure of its full scope or all of its features.

In one aspect the present disclosure relates to an apparatus for electroplating an element. The apparatus may comprise a cathode cage assembly. The cathode cage assembly may include a cage member and at least one electrically conductive wire extending along at least a portion of the cage member. The wire may be arranged to form at least one volume within the cage member for retaining an element within the cage member. The cage member and the wire permit a degree of movement of the element during an electroplating process while retaining the element within the volume.

In another aspect the present disclosure relates to an apparatus for electroplating an element. The apparatus may comprise a cathode cage assembly. The cathode cage assembly may include a tubular cage member and a plurality of lengths of spaced apart, electrically conductive wires extending parallel to one another, and which extend through portions of the tubular cage member to form a plurality of adjacent but separate volumes within the cage member. The separate volumes each retain a respective, separate element therein. The separate volumes also permit a degree of axial movement of the element, relative to the cage member and the electrically conductive wires, during an electroplating process while retaining the elements within their respective said volumes.

In still another aspect the present disclosure relates to a method for forming a cage assembly for use in electroplating spherical mandrels with a uniform metallic coating. The method may comprise providing a cage member formed from an electrically non-conductive material. The method may further include securing a plurality electrically conductive wires to the cage member in a spaced apart configuration, wherein the electrically conductive wires are arranged generally parallel to one another such that the electrically conductive wires and portions of the cage member cooperate to form a plurality of adjacent but separate volumes. The method may further include forming the separate volumes such that each is dimensioned to capture a respective one of the spherical mandrels therein while permitting a degree of movement of the spherical mandrels during an electroplating operation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
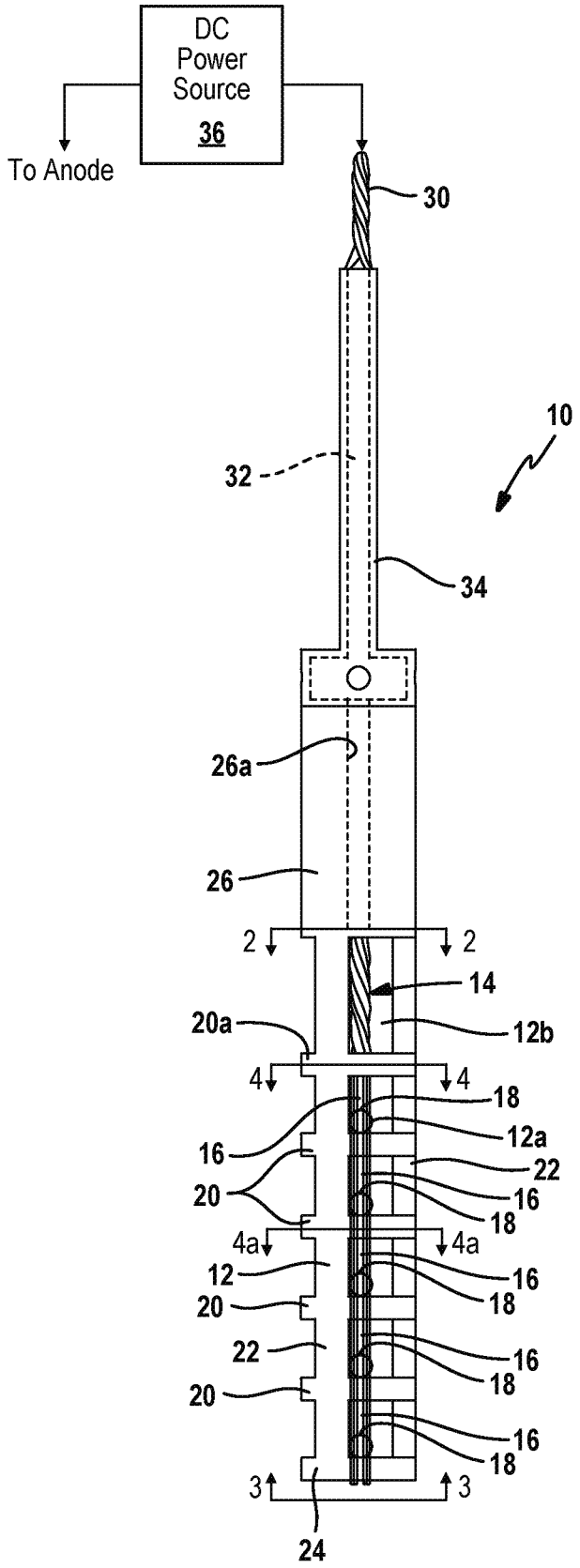
FIG. 1 is a high level diagram of a cathode cage assembly in accordance with one embodiment of the present disclosure showing the cathode cage assembly coupled to a DC power source.
Figure 4:
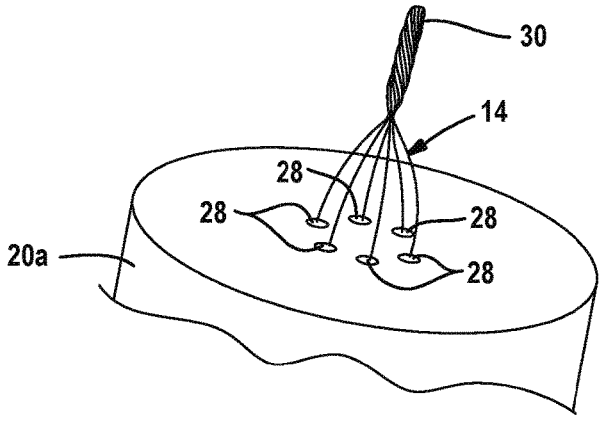
FIG. 4 is a perspective view of an upper section of the cage assembly illustrating how the wires are twisted together to form a twisted wire length, and with section lines being omitted to avoid obscuring features of the cage assembly.
Figure 4A:
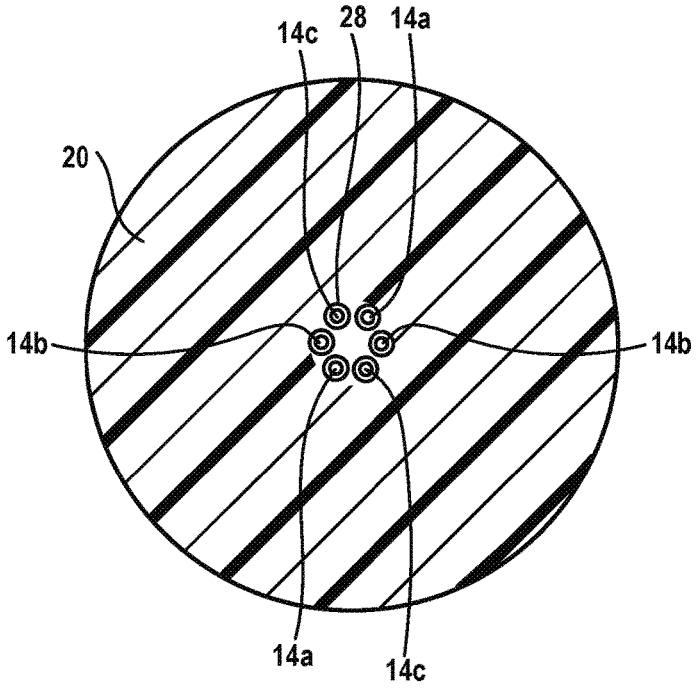
Figure 5:
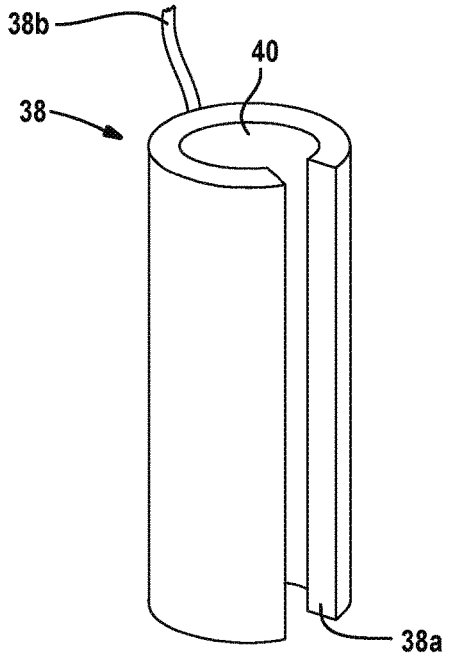
Figure 6:
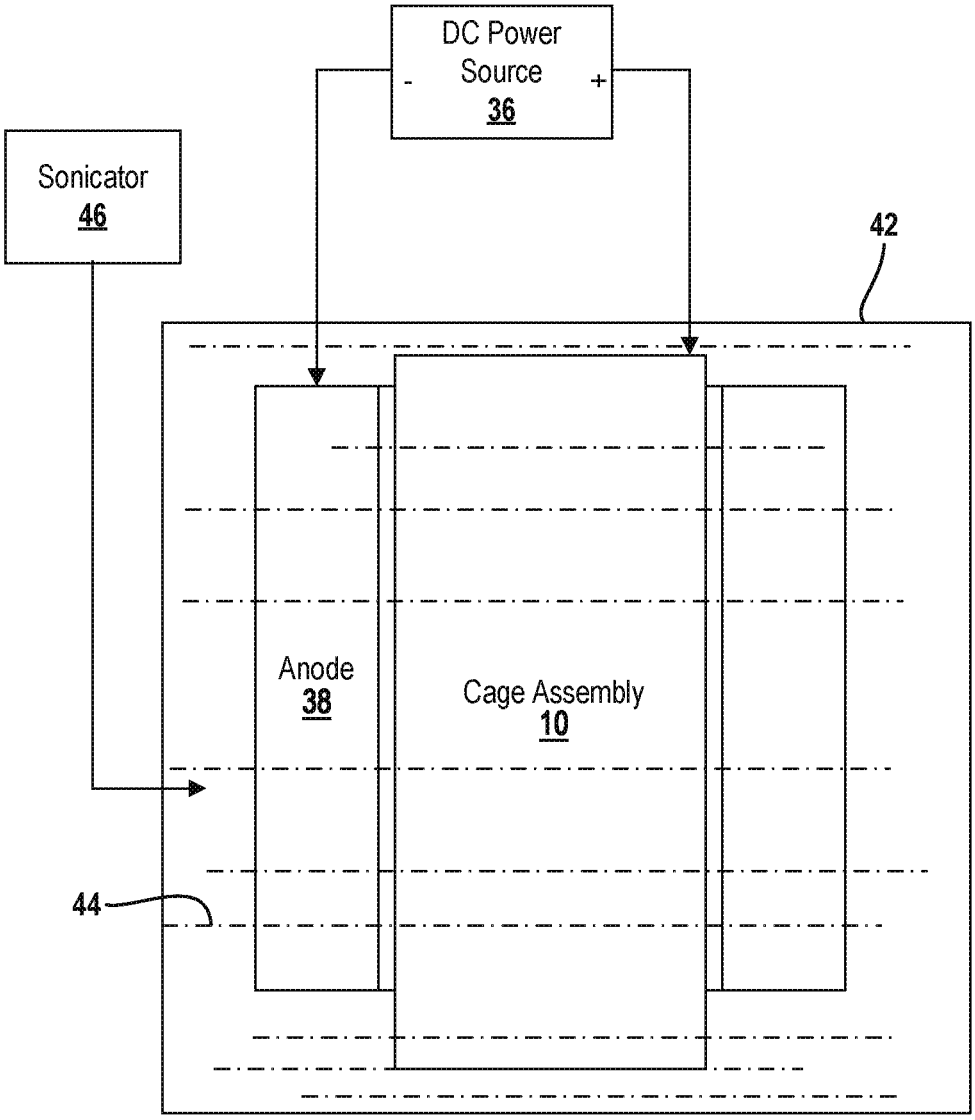
Figure 7:
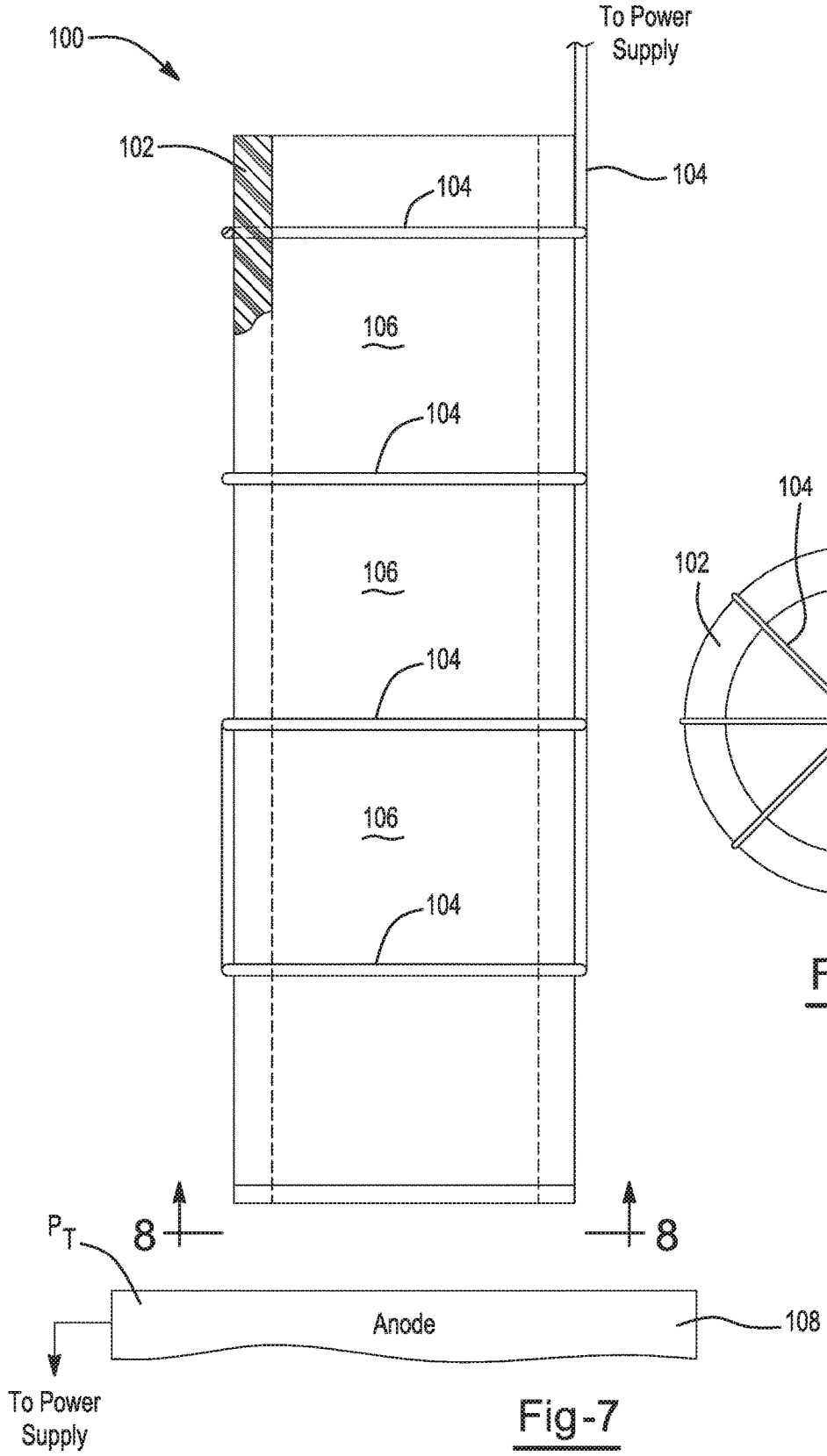
Figure 8:
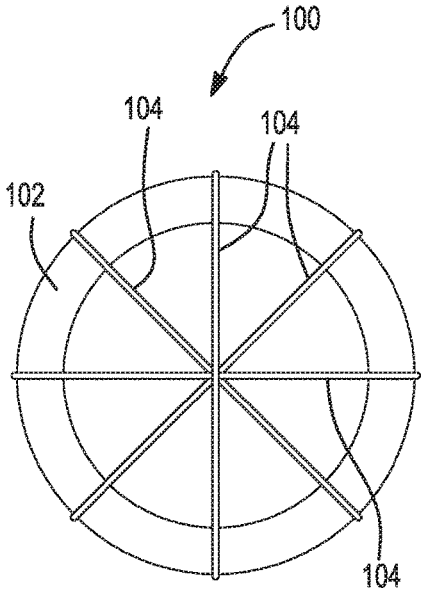

FIG. 4*a* is a cross-sectional view of the cage member taken in connection with section line 4*a*-4*a* in FIG. 1;

FIG. 5 is a perspective view of one example of an anode that may be used with the cathode cage assembly of the present disclosure during an electroplating process;

FIG. 6 is a simplified side view of the cathode cage assembly and the anode positioned in a reservoir containing an electrolyte bath solution, during an electroplating process;

FIG. 7 is a side cross sectional view of a cage assembly in accordance with another embodiment of the present disclosure where one or more wires are threaded through the internal cross-sectional area of a tube at axially spaced apart locations along a length of the tube; and FIG. 8 is a bottom view of the cage assembly taken in accordance with section line 8-8 in FIG. 7, illustrating one example of how the wires may be threaded through the tube to form a wall.

Corresponding reference numerals indicate corresponding parts throughout the several views of the drawings.

DETAILED DESCRIPTION

Example embodiments will now be described more fully with reference to the accompanying drawings.

The present disclosure is directed to a cage assembly which is effective in enabling a highly uniform metallic coating to be applied to a spherical object, and more particularly to a microspherical object which may be only a few millimeters in diameters, or even less.

Figure 3:
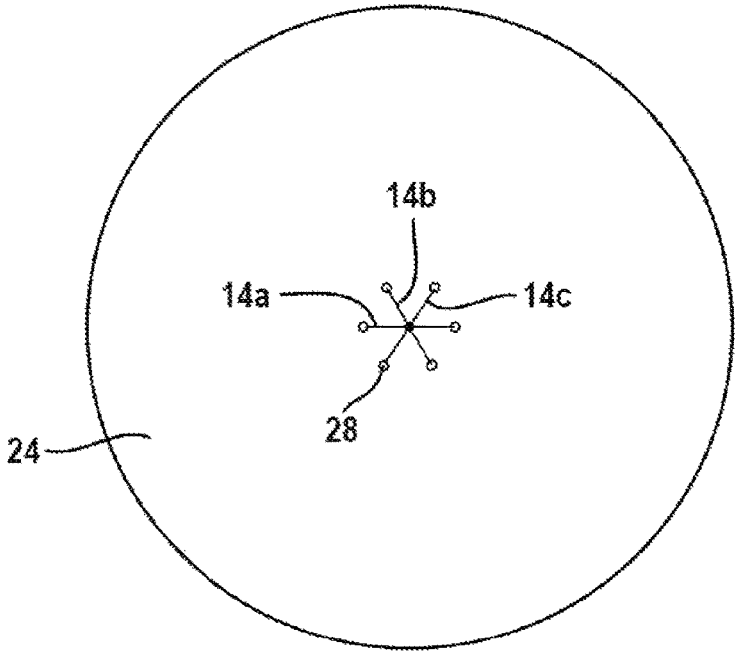
FIG. 3 is a cross sectional view of the cage member of FIG. 1 taken in accordance with section line 3-3 in FIG. 1.

Referring to FIG. 1, a cathode cage assembly 10 in accordance with one embodiment of the present disclosure is shown. The cathode cage assembly 10 (hereinafter simply "cage assembly" 10) forms a cathode of an electroplating system. The cage assembly 10 may include a cage member 12 having a central area 12*a* through which one or more electrically conductive wires 14 extend. In one preferred implementation three independent wires 14*a*, 14*b* and 14*c* are inserted through the cage member 12 and reside within the central area 12*a*, as shown in FIG. 3 and as will be described in greater detail in the following paragraphs. The wires 14 may be formed from copper or any other metallic material that has excellent electrical conductivity. The wires 14, in combination with the cage member 12, form a plurality of distinct, independent internal volumes 16 which each help to form a cage to retain a mandrel microsphere 18 therein. While five distinct volumes 16 are shown in FIG. 1, the number of volumes (i.e., cells or cages) formed in the cage member 12 could be greater or less than five, and five independent volumes 16 is only meant to illustrate one example configuration for the cage member 12. For example, the cage member 12 could be formed to contain just a single volume 16, or possibly much greater than five volumes (e.g., 30 or greater).

In one example the microsphere 18 may be made from a metal, but in other embodiments the microsphere may be made from other materials, for example from plastic or another dielectric material, that has a thin conductive metal layer (e.g., 100 nm thick) that has been flashed onto the plastic. And while a plurality of wires 14 form one preferred implementation, a single wire 14 may be used instead. The use of a single wire 14 will involve inserting and looping the wire, in an undulating fashion, repeatedly through the cage member 12 a plurality of times to form the volumes 16. Accordingly, the internal volumes 16 may be formed by using 1, 2, 3 or even greater numbers of distinct lengths of wire 14, and the presently illustrated embodiment of the cage assembly 10 using three independent wires 14*a*, 14*b* and 14*c* is just one example of how the cage assembly may be constructed. In some applications it may be found that the fewer wires that are used the better. In the example shown in FIG. 1, the wires 14*a*-14*c* are all conducting. However, another embodiment could make use of just one conducting wire and the remainder being non-conducting wires. A principal function of the wires 14*a*-14*c* is to allow concentration gradients that build up near the cathode to diffuse into the bulk electrolyte as rapidly as possible. Also, the absolute number of wires used is arbitrary. All that is required is that the cage openings (i.e., spacings between adjacent wires 14) are smaller than the microspheres 18 so that the microspheres cannot escape from the cage assembly 10.

The cage member 12 may be formed from any non-conductive material (i.e., dielectric material) such as plastic or ceramic, although plastic is particularly desirable for its ease of fabrication and relatively low cost. The cage member 12 may be formed as a single piece component, for example through a conventional injection molding or additive manufacturing techniques, or it may be formed from two or more separate component sections that are secured fixedly together using adhesives or mechanical fastening elements. In this example the cage member 12 is a single piece component that includes a plurality of circumferential ribs 20 and uppermost rib 20*a* which project perpendicularly from a plurality of axially extending, elongated frame sections 22. A bottom wall 24 closes off the bottom of the cage member 12, and a top section 26 enables ends of the wires 14*a*-14*c* to be brought out from the cage member.

FIG. 3 illustrates the bottom wall 24 having a plurality of six holes 28, with each hole being slightly larger (e.g., the hole is preferably about 10-100% larger) than the diameter of the wire 14, to allow for easy threading of the wires 14 through the holes 28. The wires 14*a*-14*c* preferably overlap at about the axial center of the cage member 12. Thus, wire 14*a* may be fed through two radially opposing first and second ones of the six holes 28, wire 14*b* may be fed through third and fourth ones of the six holes 28, and wire 14*c* may be fed through fifth and sixth ones of the holes 28. The six holes 28, which in this example form a generally circular arrangement, are formed in each of the rib sections 20, and the bottom wall 24 (as shown in FIG. 3). This enables straight, axially extending parallel pathways to be formed in the cage member 12 for threading the wires 14*a*, 14*b* and 14*c* through a substantial portion of the axial length of the cage member. The wires 14*a*-14*c* may vary widely in wire gauge to meet particular applications, but in most instances where microspheres are being coated, it is expected that the wires 14*a*-14*c* will have a gauge of between 36-40. And while a generally circular pattern is formed by the holes 28 (as visible in FIGS. 3 and 4*a*), it will be appreciated that the precise arrangement of holes 28 may depend at least in part on the shape of the object(s) that is/are being electroplated.

As such, the present disclosure is not limited to only a circular configuration for the holes 28.

Figure 2:
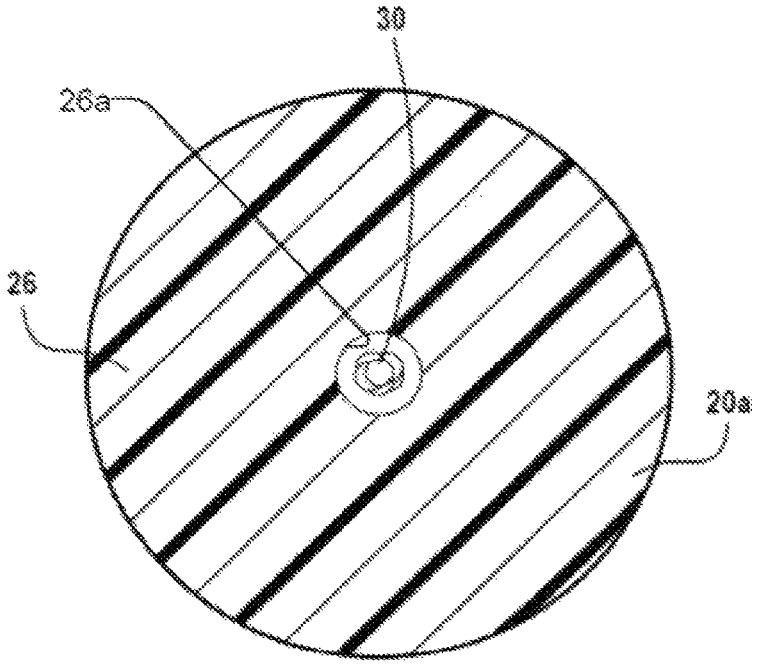
FIG. 2 is a cross sectional view of a cage member of the cage assembly taken in accordance with section line 2-2 in FIG. 1.

Within volume section 12*b* of the cage member 12, which is above uppermost rib 20*a* in FIG. 1, the free ends of each of the wires 14*a* may be twisted together to a twisted length section 30. This is also illustrated in FIG. 4. The twisted length section 30 may be fed through a bore 26*a* in the top section 26 of the cage member 12 (see FIG. 2), as well as through an internal void 32 in an upper cage supporting element 34. The twisted length section 30 may then be coupled to a DC power source 36. Alternatively the twisted length section 30 could be brought out through a volume 12*b* just above the uppermost rib 20*a*, and run up along top section 26, which would obviate the need to thread the twisted length section through the interior of the top section 26 and the upper cage supporting element 34.

During assembly, it has found to be helpful to initially thread the three wires 14*a*-14*c* through the holes 28 in the cage member 12, and then before twisting the ends of the wires 14*a*-14*c* into the twisted length section 30, to insert the microspheres into each of the volumes 16. Since the wires 14*a*-14*c* are loose at this point, they can be manipulated slightly (i.e., slightly spread apart) when inserting each of the microspheres 18. Once the microspheres 18 are each positioned in their respective volumes 16, the upper ends of the wires 14*a*-14*c* may be twisted together to form the twisted length section 30. To aid in handling and inserting the microspheres 18 into the volumes 16, a well-known vacuum pick-up system with pick-up pen may be used to handle the microspheres 18 and insert them into their respective volumes 16.

Referring briefly to FIG. 5, one example of an anode 38 is shown that may be used with the cage assembly 10 during an electroplating operation to plate the microspheres 18. In this example the anode 38 is formed somewhat with a doughnut shape and an optional cutout 38*a*. An electrical conductor 38*b* may be attached to the anode for eventual coupling to the DC power source 36. An internal diameter of an opening 40 of the anode 38 is slightly larger than the outer diameter of the cage assembly 10 so that the cage assembly 10 may reside inside the opening 40 without contacting an internal wall portion of the anode. Preferably the anode 38 has an axial length which is similar to the axial length portion of the cage assembly 10 where the microspheres 18 are present, although the anode 38 may be slightly longer or shorter than this portion without tangibly affecting the plating of the microspheres 18. While the anode 38 is shown having a cylindrical outer shape, the outer shape need not be cylindrical, and may be modified to best suit particular applications.

FIG. 6 shows another high level diagram with the cage member 12 positioned in a reservoir 42 containing an electrolyte bath solution 44. A sonicator 46 may be used to apply ultrasonic energy to the electrolyte bath solution 44. The DC power source 36 applies a potential difference across the anode 38 and the wires 14*a*-14*c* of the cage assembly 10. The ultrasonic energy agitates the electrolyte bath solution 44 and causes the microspheres 18 to move rapidly up and down the wires 14*a*-14*c* repeatedly in an oscillating fashion while rotating in random directions, but while staying in motion at all times. In an alternative embodiment the entire cage assembly 10 could be vibrated sufficiently to achieve the electroplating of the microspheres 18. In either event, this enables a highly uniform metallic coating to be formed (i.e., plated) onto the microspheres 18. The coating is absent the undesirable features that would be present if electrodes had to be attached to each of the microspheres 18 during this electroplating process. Furthermore, the electroplating process is not affected by microspheres that float or sink; the same uniform coating is achieved regardless of the buoyancy of the microspheres 18.

An important advantage of the cage member 12 is that the wires 14*a*-14*c* have a low surface area relative to the microspheres 18. This minimizes unproductive depletion of metal ions in the electrolyte bath solution 44. Also, the open cage architecture enhances anion diffusion away from the microspheres 18 that is induced by stirring, sonication and flowing agitation methods.

Still another advantage of the cage assembly 10 is that the wires 14*a*-14*c* are relatively inexpensive and easily replaced when needed, and there is no need to replace the cage member 12. Still further, the cage assembly 10 works equally well and effectively with microspheres 18 that sink or float. The open structure of the cage assembly 10 allows electrolyte bath solution 44 to recirculate around the microspheres 18 when the electrolyte bath solution is agitated by stirring and/or ultrasonic energy. The ultrasonic vibrations and/or vibration applied directly to the cage member 12 keeps the microspheres 18 in constant motion. Since the microspheres 18 are in constant motion while in contact with the wires 14*a*-14*c*, rather than static against the wires, this avoids the possibility of sticking between the wires 14*a*-14*c* and the microspheres.

While the foregoing description has been focused around the electroplating of microspheres 18, it will be appreciated that the cage system 10 is not limited to use with only spherical shaped elements. Freestanding, sub-millimeter sized elements having non-spherical shapes, as well as irregular or non-uniform shapes, may be electroplated with equal ease and efficiency using the cage assembly 10. The actual volume defined by the volumes 16 may be selected to provide a slightly greater clearance between non-spherical and/or non-uniform shaped elements and the wires 14*a*-14*c*, to ensure that random motions of the elements along the wires will be achieved while sonication is taking place.

FIG. 7 shows a cage assembly 100 in accordance with another embodiment of the present disclosure. The cage assembly 100 in this embodiment may include a dielectric (e.g., plastic or other non-conductive material) tube 102 through which one or more wires 104 are threaded to form one or more distinct volumes 106 within the tube 102. The wires 104 are threaded so as to extend across the internal area of the tube 102 at one or more places along the axial length of the tube, which forms the distinct volumes 106 within the tube 102. In effect, each volume 106 forms a separate "cage" within the tube 102 for containing an element being electroplated. The element may be the microsphere 18 or it may be a different shaped element having a uniform or non-uniform shape. If a single wire 104 is used, then the wire may be threaded through a wall of the tube 102 at different points along the axial length of the tube, possibly in somewhat of a serpentine pattern, as needed to form the desired number of volumes 16 within the tube. If two or more wires 104 are used, they should be connected at various points along the exterior surface of the tube 102 as needed so that the wires 104 collectively form parallel flow paths for current flow. Accordingly, it will be appreciated that the pattern(s) used to thread the wire(s) 104 through the tube 102 may be varied considerably without departing from the teachings presented herein. The principal object is to use the wire(s) to form the plurality of distinct volumes 106 which can act as separate "cages" to hold the element being plated within its respective volume during sonication.

FIG. 7 also shows an anode 108 which may be positioned closely adjacent a surface of the tube 102. In this example the anode 108 is shown as a platinum plate and positioned closely adjacent a lower surface of the tube 102. However, the positioning of the anode 108 may be varied, for example positioned parallel to the axial length of the tube 102, instead of below the tube.

FIG. 8 shows one example as to how the wire 104 may be threaded through the cross-sectional internal area of the tube 102 to effectively form a wall that helps to form the volume 106. In the example of FIG. 8, the wire 104 passes through the interior cross-sectional area of the tube 102 four times, but this is just one example. It may be possible to form each volume 106 with only a single pass of the wire 104 through the interior cross-sectional area of the tube 102, depending on how close the internal diameter of the tube is to the outer dimension of the element being contained. In some applications it may be desirable to pass the wire(s) 104 through the tube 102 more than four times. The outer shape of the element being coated may also dictate at least in part how many times the wire 104 needs to be threaded through the tube 102.

The wire(s) 104 may be formed from copper or any other material which has excellent electrical conductivity. The gauge of the wire 104 may also vary depending on the specific application. The threading of the wire 104 need not necessarily start at the very top of the tube 102. It is possible that the threading could begin at some midpoint along the axial length of the tube 102.

While a single tube 102 has been shown in FIGS. 7 and 8, it will be appreciated that this is just one example of a suitable configuration for the tube. It is also possible to form a plurality of tubes together as a single integrated assembly, for example in a honeycomb-like pattern or other pattern, and then stitch the wire 104(*s*) through the plurality of tubes as needed to form the number of required volumes in each tube. Those skilled in the art will appreciate that the cage assembly 100 discussed herein is readily scalable to meet the needs of applications where large numbers (e.g., dozens, hundreds or more) elements require electroplating.

For the above described cage assembly 100, it should be appreciated that the electrolyte is preferably "pulsed" pumped (e.g., using a diaphragm or peristaltic pump) through the tube 102. This agitation "refreshes" the electrolyte in vicinity of the microsphere (or other form of element being plated) and also induces motion to the microsphere thus avoiding the possibility of sticking to wires 104. The pulsed pumping of the electrolyte also randomizes the effective electric field between microsphere and anode 108, resulting in a more uniform coating thickness. And as noted above, for the cage assembly 10, the electrolyte in preferably submerged in an ultrasonicator.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus for electroplating an element, the apparatus comprising:

a cathode cage assembly, the cage assembly including:

a cage member;

a plurality of wires, with least one of the wires being an electrically conductive wire configured to receive an electrical current during an electroplating operation, the wires extending along at least a portion of the cage member, the wires being arranged to form at least one volume within the cage member for retaining an element within the cage member while permitting rotation of the element in random directions; and wherein the cage member and the wires permit random rotational movement of the element during an electroplating process while still retaining the element in electrical contact with the at least one wire while positioned within the volume.

2. The apparatus of claim 1, wherein the wires extend parallel to a length of the cage member.

3. The apparatus of claim 1, wherein the wires extend perpendicular to a length of the cage member.

4. The apparatus of claim 1, wherein the cage member comprises a non-electrically conductive material.

5. The apparatus of claim 1, wherein the cage member is formed from at least one of plastic material or ceramic material.

6. The apparatus of claim 1, wherein the cage member includes:

a plurality of parallel extending, elongated frame sections;

a plurality of ribs arranged non-parallel to the elongated frame sections;

a top section at one end of the frame sections;

a bottom wall at a second end of the frame sections; and wherein the wires, the elongated frame sections and the ribs define a plurality of adjacent, but spaced apart, internal volumes for containing the element and at least one additional element within separate volumes.

7. The apparatus of claim 1, further comprising an anode shaped to substantially surround a major portion of the cage member.

8. The apparatus of claim 7, wherein the cage member has a circumferential shape and the anode has an annular configuration.

9. The apparatus of claim 7, further comprising a DC power source for applying a DC voltage across the wire and the anode.

10. The apparatus of claim 9, further comprising:

a reservoir;

an electrolyte bath contained by the reservoir, wherein the cage member and the element are disposed in the electrolyte bath; and a sonicator for applying ultrasonic energy to the electrolyte bath.

11. An apparatus for electroplating an element, the apparatus comprising:

a cathode cage assembly, the cage assembly including:

a tubular cage member;

a plurality of lengths of spaced apart, electrically conductive wires extending parallel to one another, and extend through portions of the tubular cage member to form a plurality of adjacent but separate volumes within the cage member, the separate volumes each retaining a respective, separate element therein; and wherein the separate volumes permit a degree of movement of the element, relative to the cage member and to the electrically conductive wires, during an electroplating process while retaining the elements within their respective said volumes.

12. The apparatus of claim 11, wherein the plurality of conductive wires are arranged to run parallel to a length of the cage member.

13. The apparatus of claim 11, wherein the plurality of conductive wires are arranged to run perpendicular to a length of the cage member.

14. The apparatus of claim 11, wherein the plurality of lengths of the electrically conductive wire are formed from a single length of wire which is looped a plurality of times at two ends of the cage member.

15. The apparatus of claim 11, wherein the plurality of lengths of the electrically conductive wire are formed from independent sections of wire and tied together at one end.

16. The apparatus of claim 11, further comprising:

a reservoir;

an electrolyte bath contained in the reservoir, the cage member being at least partially submerged in the electrolyte bath; and a sonicator for applying ultrasonic energy to the electrolyte bath.

17. A method for forming a cage assembly for use in electroplating spherical mandrels with a uniform metallic coating, the method comprising:

providing a cage member formed from an electrically non-conductive material;

securing a plurality of electrically conductive wires to the cage member in a spaced apart configuration, wherein the electrically conductive wires are arranged generally parallel to one another such the electrically conductive wires and portions of the cage member cooperate to form a plurality of adjacent but separate volumes;

each said separate volume further being dimensioned to capture a respective one of the spherical mandrels therein while permitting a degree of movement of the spherical mandrels during an electroplating operation.

18. The method of claim 17, further comprising at least one of:

arranging the plurality of electrically conductive wires parallel to a length of the cage member; or arranging the plurality of electrically conductive wires perpendicular to the cage member.

19. An apparatus for electroplating an element, the apparatus comprising:

a cathode cage assembly, the cage assembly including:

a cage member;

at least one electrically conductive wire extending along at least a portion of the cage member, the wire being arranged to form at least one volume within the cage member for retaining an element within the cage member;

wherein the cage member and the wire permit a degree of movement of the element during an electroplating process while retaining the element within the volume; and wherein the cage member further includes:

a plurality of parallel extending, elongated frame sections;

a plurality of ribs arranged non-parallel to the elongated frame sections;

a top section at one end of the frame sections;

a bottom wall at a second end of the frame sections; and wherein the wire, the elongated frame sections and the ribs define a plurality of adjacent, but spaced apart, internal volumes for containing the element and at least one additional element within separate volumes.

* * * * *